US011445833B2

(12) United States Patent
Franks

(10) Patent No.: US 11,445,833 B2
(45) Date of Patent: Sep. 20, 2022

(54) COMBINATION BACKPACK AND CONVERTIBLE INFANT CHANGING STATION

(71) Applicant: Sean Franks, Macomb, MI (US)

(72) Inventor: Sean Franks, Macomb, MI (US)

( * ) Notice: Subject to any disclaimer, the term of this patent is extended or adjusted under 35 U.S.C. 154(b) by 248 days.

(21) Appl. No.: 16/916,225

(22) Filed: Jun. 30, 2020

(65) Prior Publication Data

US 2021/0000264 A1 Jan. 7, 2021

Related U.S. Application Data

(60) Provisional application No. 62/870,334, filed on Jul. 3, 2019.

(51) Int. Cl.

| | |
|---|---|
| ***A45F 4/06*** | (2006.01) |
| ***A47D 5/00*** | (2006.01) |
| ***A45F 3/04*** | (2006.01) |
| ***A45F 3/14*** | (2006.01) |

(52) U.S. Cl.

CPC ..... *A47D 5/006* (2013.01); *A45F 3/04* (2013.01); *A45F 3/14* (2013.01); *A45F 4/06* (2013.01); *A47D 5/003* (2013.01); *A45F 2003/142* (2013.01)

(58) Field of Classification Search

CPC .. A47D 5/006; A47D 5/003; A47D 2003/142; A45F 3/04; A45F 3/14; A45F 4/06

USPC ..... 5/655

See application file for complete search history.

(56) References Cited

U.S. PATENT DOCUMENTS

| | | | | |
|---|---|---|---|---|
| 5,649,658 | A * | 7/1997 | Hoffman | A47D 5/006 5/655 |
| 8,490,230 | B2 * | 7/2013 | Rovin | A47D 5/006 5/655 |
| 9,771,183 | B1 * | 9/2017 | Oliver | A45C 3/00 |
| 9,918,563 | B1 * | 3/2018 | Lockett | A45F 3/04 |
| 2006/0032881 | A1 | 2/2006 | Price et al. | |
| 2011/0023236 | A1 | 2/2011 | Sanders et al. | |
| 2014/0259394 | A1 | 9/2014 | Iskowitz | |
| 2014/0374305 | A1 * | 12/2014 | Fimbrez | A47D 5/006 206/581 |
| 2015/0083764 | A1 * | 3/2015 | Houston | A45C 9/00 224/156 |

* cited by examiner

*Primary Examiner* — Peter N Helvey

(74) *Attorney, Agent, or Firm* — Dinsmore & Shohl LLP

(57) ABSTRACT

A convertible backpack or carrying bag for establishing an infant changing station, including a body having a first rigid lower depth defining half and a second pivotally connected rigid upper half. A strap extends from the upper half which is adapted to secure to an elevated location in order to support the body in an open position in which the infant is supported upon the lower depth defining half. A clamp or other attachment portion can be secured to the strap and includes a "U" shaped hook portion adapted for engaging a top extending door edge. Other looped straps can also be used in combination or apart from the clamp securing strap for providing additional support when worn by a user.

8 Claims, 7 Drawing Sheets

FIG. 7
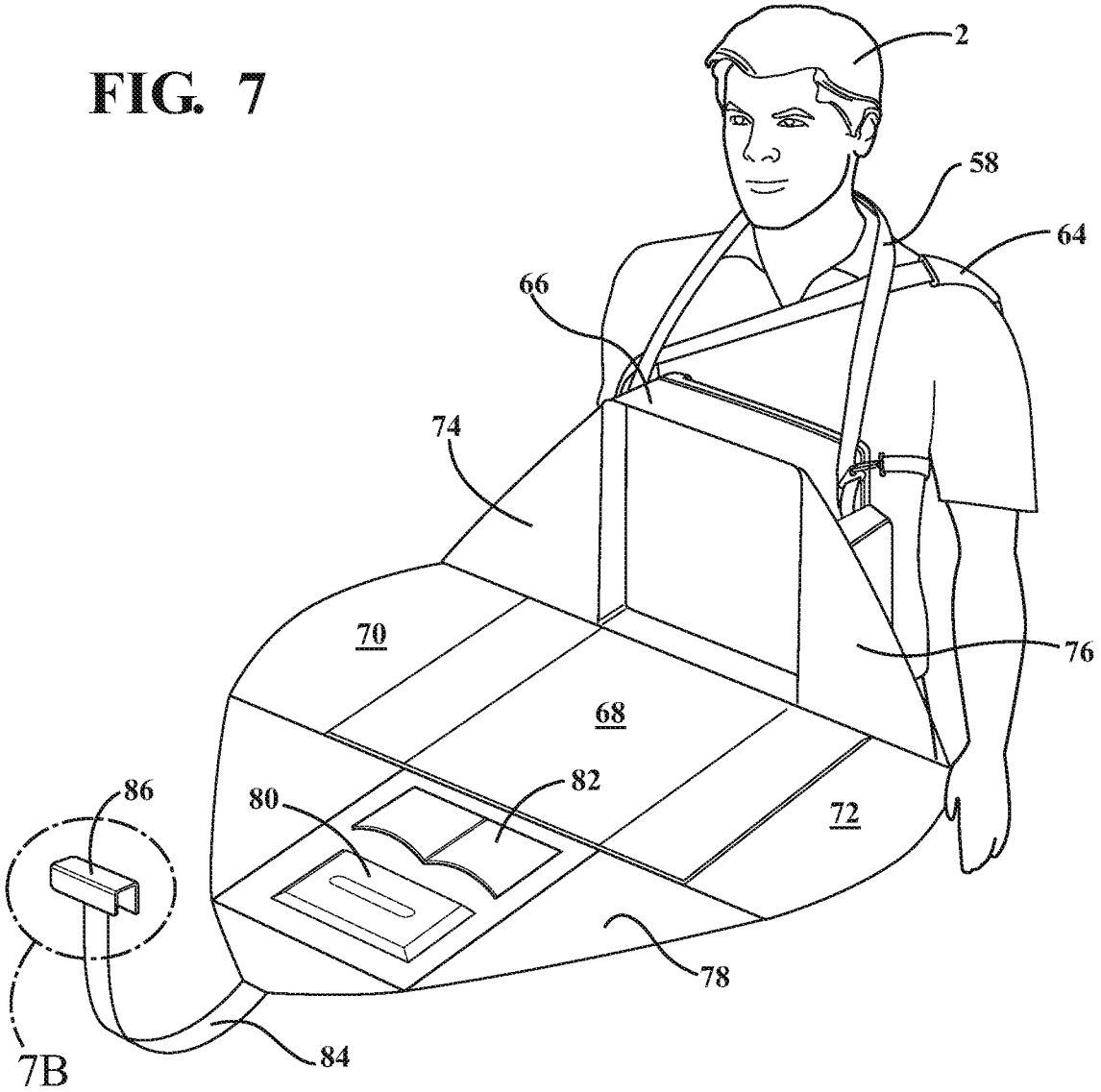
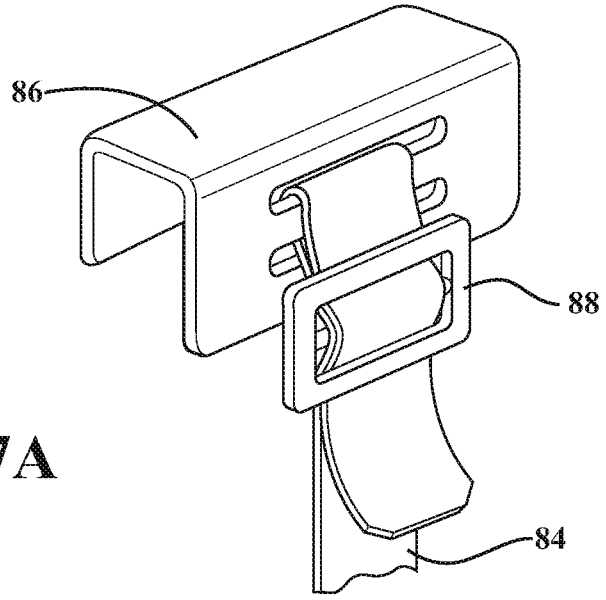
FIG. 7A

COMBINATION BACKPACK AND CONVERTIBLE INFANT CHANGING STATION

CROSS REFERENCE TO RELATED APPLICATIONS

The present application claims the priority of U.S. Ser. No. 62/870,334 filed Jul. 3, 2020.

FIELD OF THE INVENTION

The present invention discloses a backpack which converts into an infant changing station. Additional applications include suspending the open converted changing station from a wearer's shoulders, such as to permit a second individual to change an infant's diaper, and such as in the instance of a suitable support surface not being available. Alternatively, the open converted changing station can be suspended from any fixed elevated location not limited to a bathroom stall door, stall wall or stall hook. In a further application, the open converted changing station can be supported upon any horizontal surface while keeping the infant/child safe from rolling out.

BACKGROUND OF THE INVENTION

The prior art is documented with examples of infant changing assemblies, such as which can be located in many existing public restroom facilities and which include such as a wall mounted assembly which can fold outward/downward to a level orientation in order to provide a support surface for a child or infant, such as during the changing of a diaper. Shortcomings of such existing designs include both their limited availability and concerns of sanitation due to the prevalence of germs and the like.

Given the above, attempts have been made to provide portable carrying stations as an alternative to those fixed designs configured within a public restroom. A first example of this is the diaper changing backpack with removable handbag of Price, US 2006/0032881. Price teaches a backpack with an outer layer which is unfolded to convert into a diaper changing pad having a plurality of padded sections interconnected by fold lines so that the pad in the planar conditions serves as an infant changing pad.

When folded, the outer layer changing pad with the inner handbag assumes the shape and characteristics of a traditional backpack having two shoulder straps and a fastening device which secures the inner handbag. The handbag is further constructed of a liquid-impervious material which has multiple side pockets and a pair of carrying handles. The pockets and handles are accessible from either the folded or unfolded state and the handbag is secured by a fastening device at the top of the bag and, when undone, revealing a plurality of compartments for storing articles related to a traditional diaper bag and/or a women's purse.

US 2014/0259394 to Iskowitz teaches a portable baby changing station fabricated from a soft, flexible material for changing diapers in automobiles. When fully extended, the changing station provides a soft surface to rest a baby while changing a diaper with the head end affixed to the rear portion of the back seat by a fastener such as Velcro. One or more netted pockets are positioned at the head end to hold diapers and changing supplies. Once the baby has a new diaper, the changing station folds up into a compact shape while remaining fastened to the back seat, such that the assembly is held in the closed position by fasteners such as Velcro or snaps.

Additional examples of convertible backpacks with soft foldout changing pads are further depicted in each of Hoffman U.S. Pat. No. 5,649,658, Rovin U.S. Pat. No. 8,490,230 and Oliver U.S. Pat. No. 9,771,183, the contents of which are incorporated by reference.

SUMMARY OF THE PRESENT INVENTION

The present application teaches a convertible backpack and infant changing station, this including a clamshell-style body having a first rigid lower depth defining half and a second pivotally connected rigid upper half. A strap extends from the upper half which is adapted to secure to an elevated location in order to support the body in an open position in which the infant is supported upon the lower depth defining half.

An attachment portion is integrated into a location of the strap and which is adapted to engage an elevated location. The strap can further include a pair of parallel disposed straps adapted to being worn by a changing station supporting individual.

Other features include exposed receptacles defined in the second rigid upper half upon converting into the infant changing station. A comfort strap extends from a remote edge of the lower half and is adapted to being worn by an infant changing individual. Other features include an easy open pull tab configured in the rigid lower depth defining half for assisting in converting the clam-shell halves between the open and closed position.

BRIEF DESCRIPTION OF THE DRAWINGS

Reference will now be made to the attached drawings, when read in combination with the following description, wherein like reference numerals refer to like parts throughout the several views, and in which:

FIG. 7 is a further perspective illustration of the convertible changing station of FIG. 6 which is supported in an open configuration on a front side of a wearer;

FIG. 7A is an enlarged partial view of the rigid wall hanger integrated into an extending end of an adjustable strap which in turn extends from an exposed end of the converted changing station of FIG. 7;

DETAILED DESCRIPTION OF THE PREFERRED EMBODIMENTS

As will be described with reference to the attached illustrations, the present invention teaches either of a backpack (FIGS. 1-5) or a related carrying bag (FIGS. 6-8) that converts into a changing station. As will be described, non-limiting variants can include the ability to convert and suspend either variant of a convertible station from any elevated location not limited to a bathroom stall door, stall wall, and such as in combination with the convertible backpack or bag in the open position being wearable upon either the front or backside of a wearer in instances in which a safe and sanitary changing support surface is not readily available.

Figure 1:
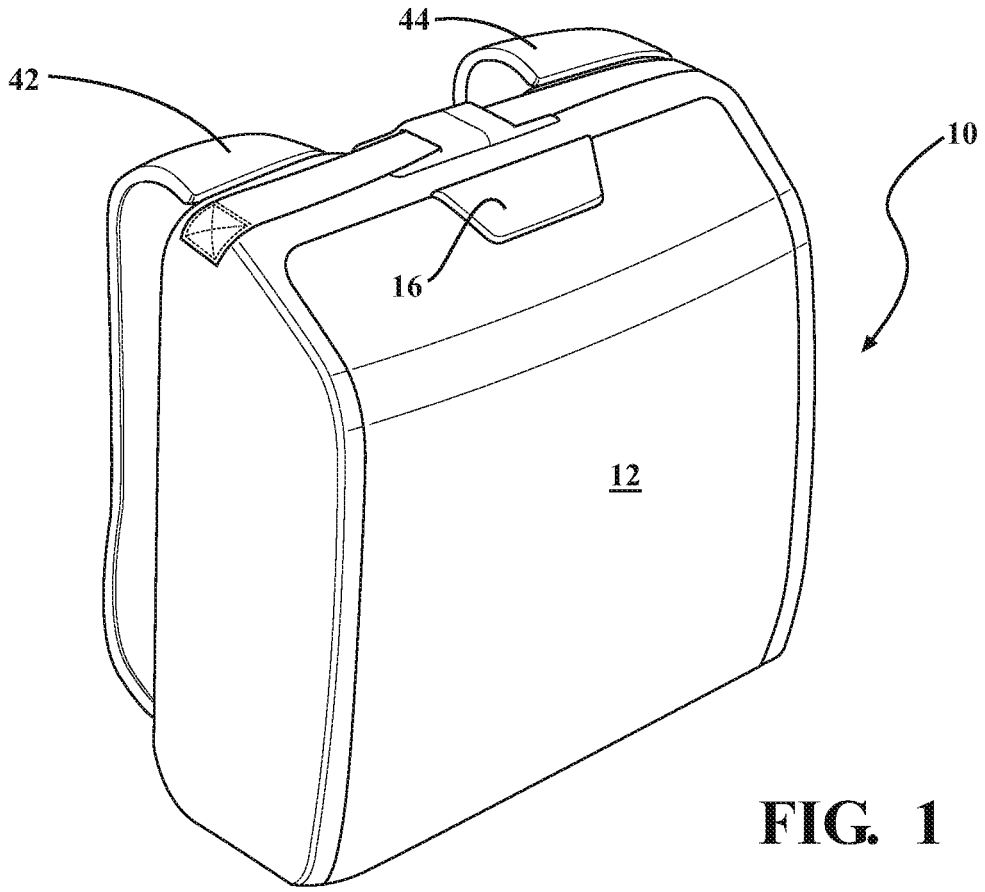
FIG. 1 is a perspective view of convertible backpack/infant changing station in a closed configuration according to a non-limiting embodiment of the present invention.
Figure 6:
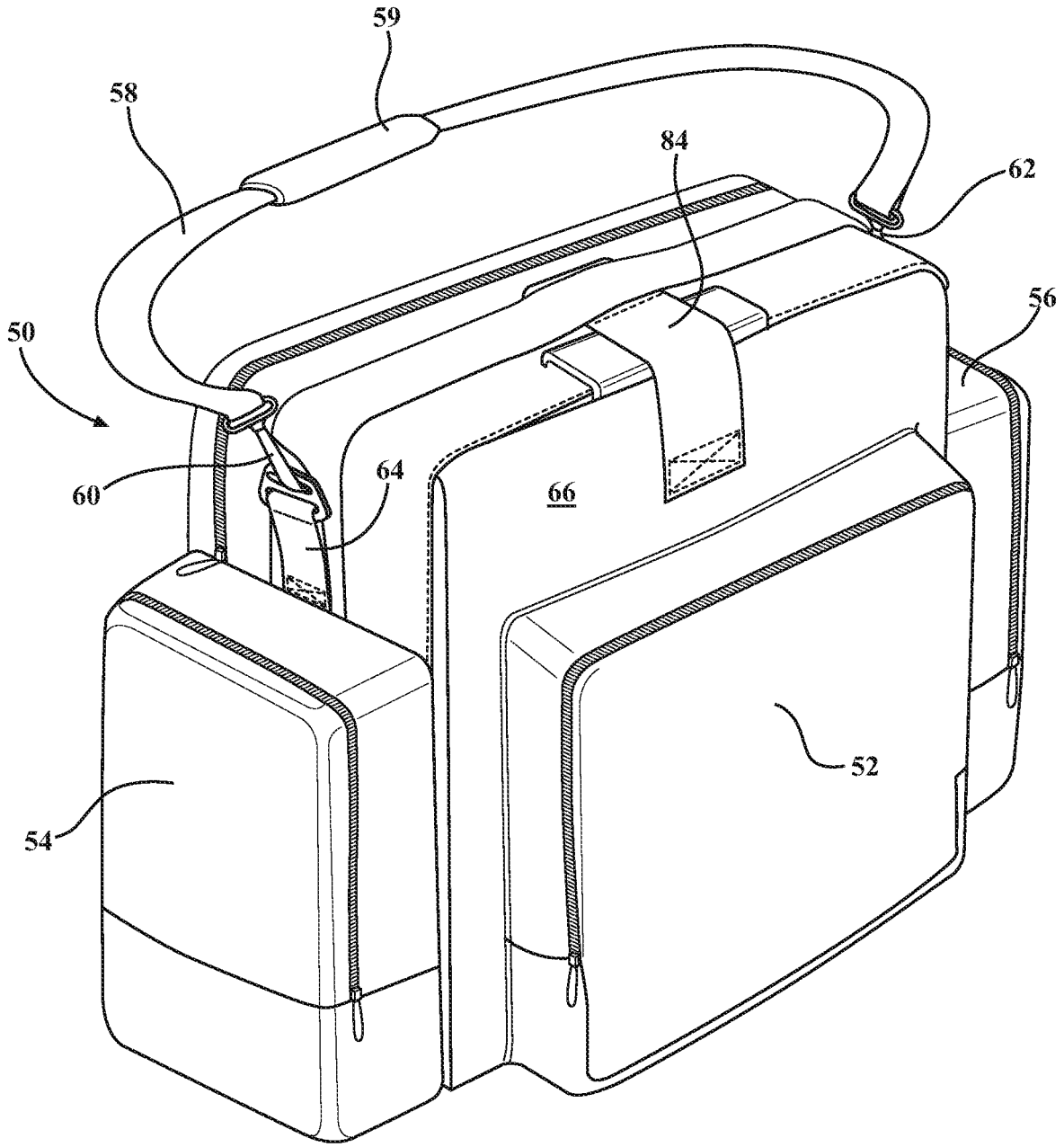
FIG. 6 is a perspective illustration of a convertible carrying bag and infant changing station according to a further non-limiting embodiment of the present invention.

In a further envisioned use application adaptable to either of the convertible backpack embodiment of FIG. 1 or the convertible bag embodiment of FIG. 6, the present invention can again be worn by a first individual while a second individual changes the infant's diaper, such again being possible in the absence of an available mounting location. Other variants again include the ability to support the convertible station directly upon a horizontal surface for changing while keeping the child safe from rolling out of the present invention when in an open converted configuration.

Referring now to FIG. 1, a perspective view of convertible backpack/infant changing station according is generally shown at 10 of a non-limiting embodiment of the present invention. The succeeding illustration in FIG. 3 further depicts of the changing station in an open converted position.

The changing station as shown incorporates a clamshell-style body having a first rigid (most broadly defined as structurally supporting and not limited to any specific material construction) lower depth defining half 12 and a second foldable or pivotally connected rigid upper half 14. As again shown in FIG. 1, an easy open pull tab 16 can be provided along an edge location of the lower depth defining half 12 opposing an opening edge location with the upper half 14, and which is opposite an underside pivotal/hinged edge for permitting opening and closing the assembly body.

Figure 3:
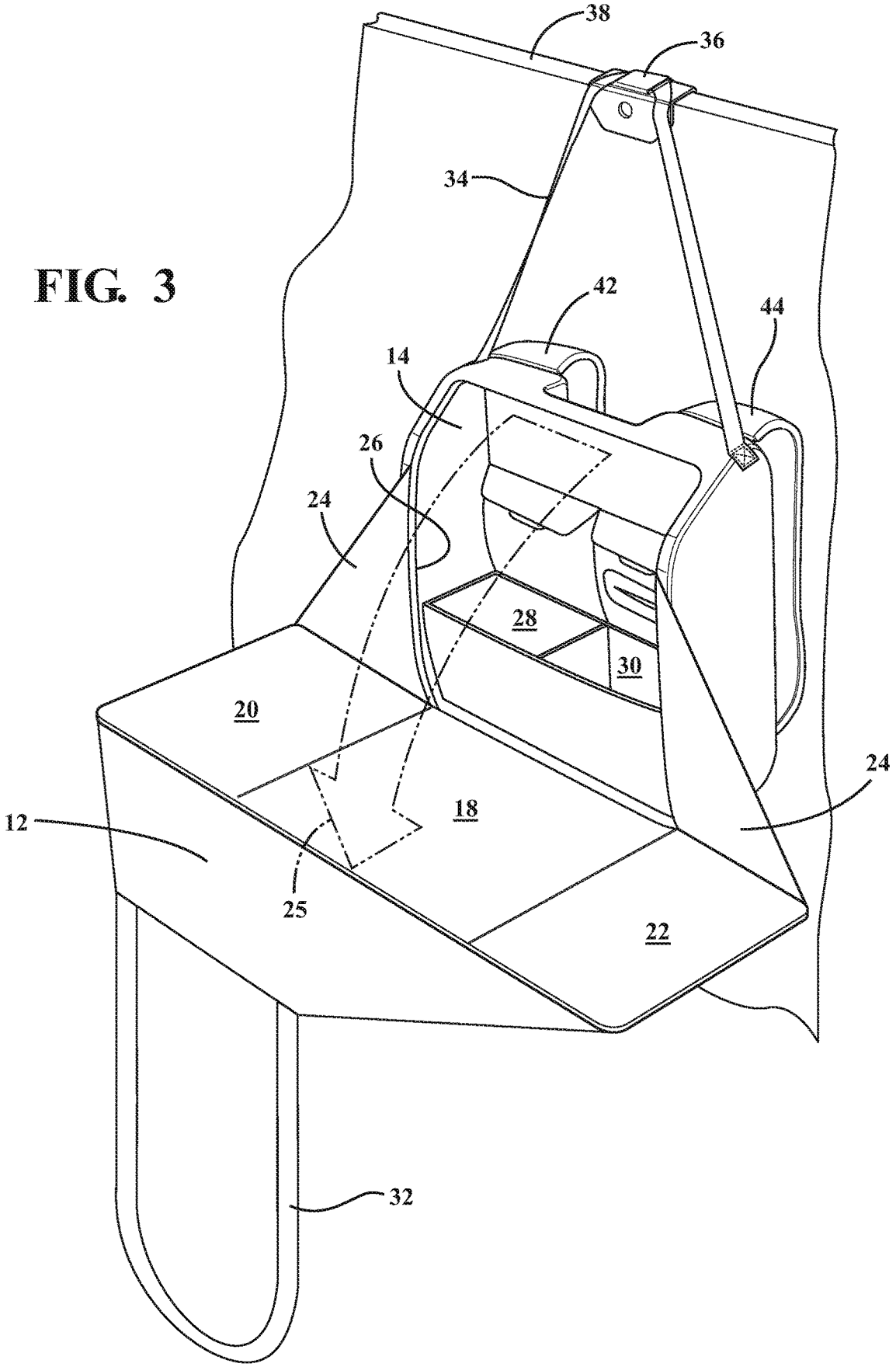
FIG. 3 is an environmental illustration of a first mounting configuration of the convertible changing station.
Figure 4:
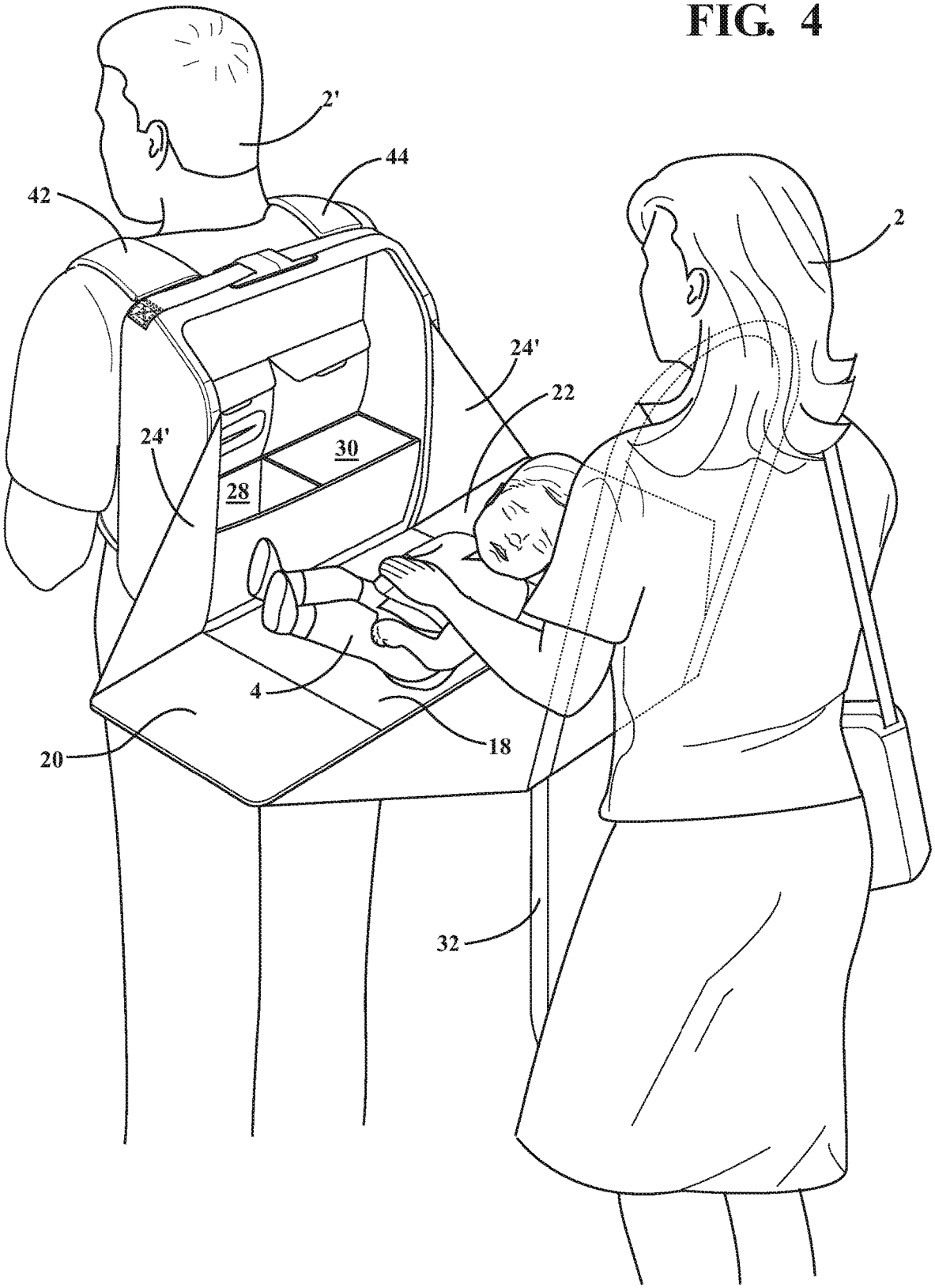
FIG. 4 is an environmental illustration of a second mounting configuration in which the changing station is supported by a pair of parallel arrayed shoulder straps upon the back of a first individual, and so that a second individual can attend to changing a horizontally supported infant secured at an elevated location.

As further shown in the open position of FIG. 3, the open folded first half 12 can include, in one non-limiting construction, a middle panel 18 and interconnecting and opposite edge angled side panels 20/22 and which, upon downwardly folding the lower half 12 in the manner depicted in FIG. 4, can be folded outwardly relative to one another (such as through the use of living hinges or other durable pivotal support structure) in order to provide a widened support surface for supporting the infant 4 thereupon.

Figure 5:
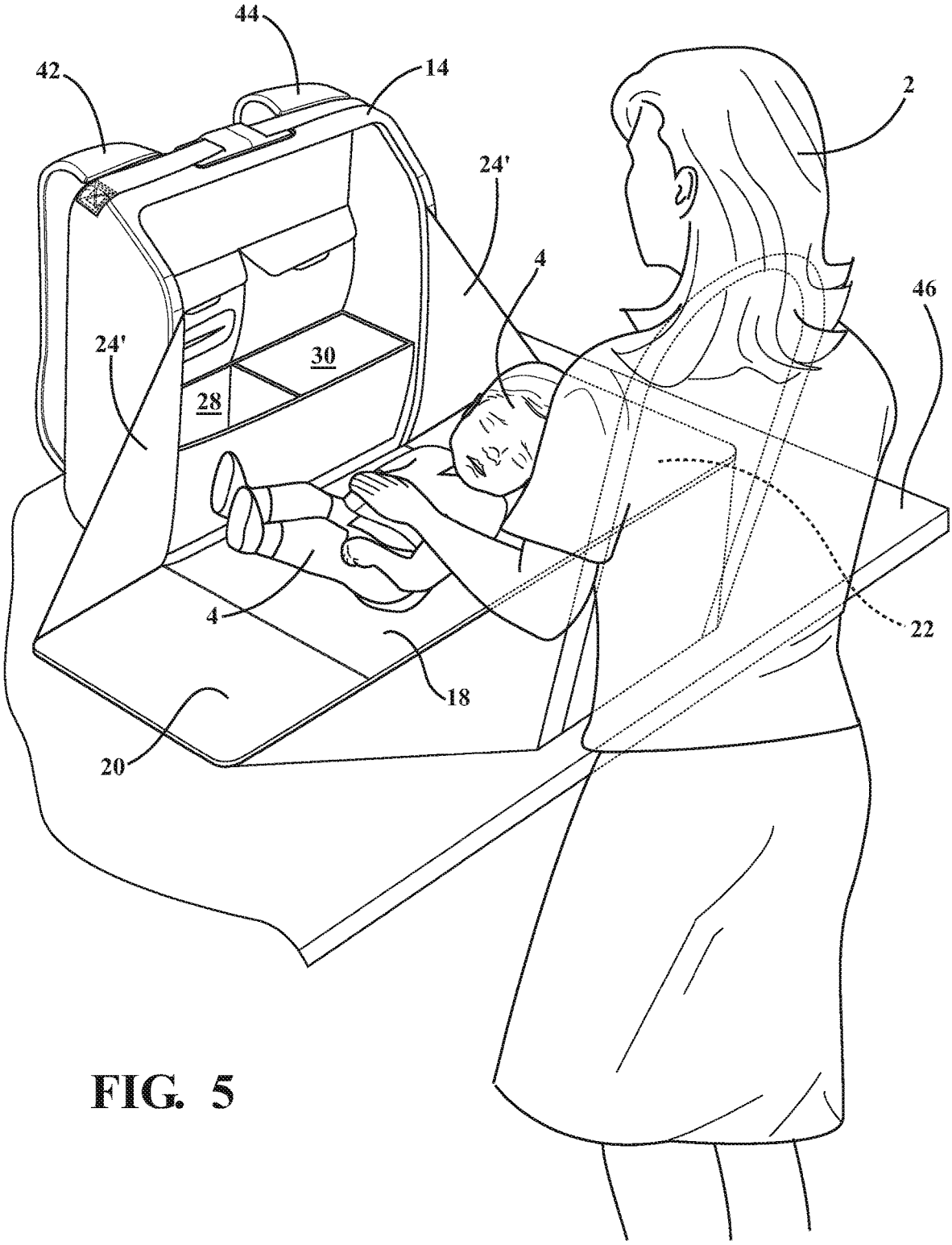
FIG. 5 is a yet further environmental illustration of the convertible changing station supported upon a horizontal table top surface.

In order to support the weight of the infant in the open position, the structurally supporting body 10 can also include side reinforcements, see for example at 24 in FIG. 3 and as further redesigned in FIGS. 4-5. As shown in FIG. 3, the side reinforcements 24 can be structurally integrated into the first foldable half 12 and which are received within receiving slots (further at 26) configured into exposed opposing side edges of the second half 14.

Without limitation, the side reinforcements 24 can be configured so that, upon engaging the easy open pull tabs 16 in the closed position of FIG. 1, the lower folded half 12 of the body will open about the hinge established with the upper half 14 in the direction of arrow 25 to a predetermined angle. Upon the lower half 12 pivoting to a relative angle such as perpendicular to the upper half 14, a recessed abutment or other engaging structure (not shown) associated with a hidden location of the side reinforcements 24 engages a further hidden catch location of the upper half 14 to establish the open position, such as in which the halves 12/14 are configured at the desired angle (again at least perpendicularly arranged) relative to one another. Without limitation, other catch or engagement structure can be provided for facilitating the opening and closing action of the body. As shown in FIGS. 4 and 5, the side reinforcements can be reconfigured as shown at 24' and are hingedly and foldably secured to vertical adjoining edges formed with each of the outer side edges of the upper half 14 and the rear edges of the outer panels 20 and 22 in order to convert the support surface of the lower half 12 to an open and widened support profile.

Also depicted in the open position of FIG. 3 are a plurality of interior compartments 28, 30, et seq., which can be formed within interior accessible locations of the upper disposed half 14, and which are exposed in proximity to the lower opened first half 12. The configuration of the interior compartments provides a user with easy access to any desired supplies (diapers, powder, wipes, etc.,) to further assist in changing the infant when supported upon the open first half interior.

As further shown in FIG. 3, a first neck strap 32 is illustrated which extends from first and second outer edges of the first clamshell half 12. As will be further described with reference to FIGS. 4-5, the strap 32 is adapted to being worn around the neck of an individual 2 for changing an infant 4 when the assembly 10 is deployed according to any of a number of different use configurations.

Also depicted in FIG. 3 is a further second strap 34 which extends from the upper half 14, at a midpoint of which is arranged a three sided (such as "C" or "U" shaped) clip 36 which is adapted to secure the overall body to an elevated location (see for example an upper door surface 38 which is partially depicted). The first strap 32 can either be left to dangle (see again as shown in FIG. 3) or can be likewise supported about a wearer's neck (see as again shown in FIGS. 4-5) in order to support the body in an open position in which the infant is supported upon the lower depth defining half.

Figure 2A:
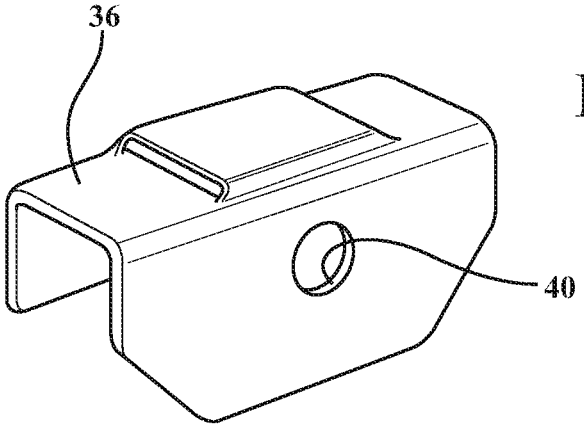
FIG. 2A depicts a solid view and FIG. 2B a substantially identical phantom view illustration of a C-clip associated with a support strap of the convertible changing station in a first selected mounting configuration depicted in FIG. 3 supported upon a top horizontal support edge of any of a public bathroom stall wall, stall door or like support surface.
Figure 2B:
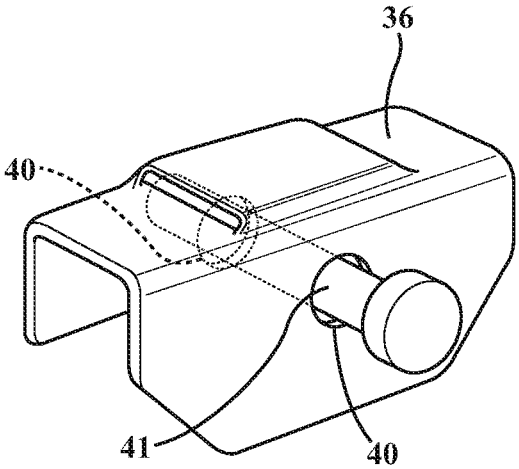

As further shown in FIG. 2A, the sectional illustration of the C-clip 36 associated with a support strap of the convertible changing station is again shown in a first selected mounting configuration depicted in FIG. 3 and so that it rests upon the top horizontal support edge of a doorway or like support surface. A mounting aperture (see annular closed rim 40) is shown extending through each of the downward legs or sides of the "C" or "U" clip 6 and, as further shown in related FIG. 2B, can receive a width extending pin 41 for optionally mounting the body to the elevated location, this such as in combination with an aligning mounting aperture formed at the elevated location of the door for securing the clip 36.

Proceeding to FIG. 3, an environmental illustration is again shown of a first mounting configuration of the present invention in which the convertible changing station 10 is depicted as substantially illustrated and by which a single individual is capable of first suspending the assembly upon the elevated location via the strap 34 and C-clip 36, following which the body 10 is opened to reveal the interior of the halves 12/14 and the infant placed within the lower open half 12. At this point, the comfort neck strap 32 can be placed about the neck of the individual such as in order to provide additional structural support to the assembly to maintain the orientation of the open halves and to prevent the open lower half 12 form pivoting to an excessive position (such as in the instance of a failure of the internal reinforcing structure for maintaining the open orientation of the open halves).

FIG. 4 is an environmental illustration of a second mounting configuration, such as in which a static elevated mounting location is not readily available and in which the changing station is supported by a pair of parallel supported shoulder straps 42 and 44, each extending from first and second locations of the body (upper half 14) and so that the body is secured upon the back of a further individual 2'. The shoulder straps 42/44 are provided additional to the second looping strap 34 for facilitating carrying of the body in the closed position and, upon opening, and so that the second individual (such as shown at 2 and whom can be wearing the first comfort strap 32 about his or her neck) can attend to changing a horizontally supported infant 4 supported at an elevated location within the opened bottom support surface of the lower body half 12. As shown in FIG. 4, the looped carrying straps 42/44 can also substitute for the looped strap 34. In particular, the second variant has application in outdoor applications where a sanitary changing environment is not easily accessed.

FIG. 5 is a yet further environmental illustration of the convertible changing station in the open configuration of FIG. 4 and supported upon a horizontal table top surface, see at 46. In this variant, the infant is again supported upon the open and outwardly folded lower half define by interconnected panels 18, 20 and 22 in a sanitary manner. A foldable changing pad (see as further depicted in the alternate variant of FIG. 2) can be supported within the body in the closed position and, upon outwardly opening and unfolding, can provide a cushioning support surface between the infant and the underlying support surface.

Proceeding to FIG. 6 is a perspective illustration is generally shown at 50 of a convertible carrying bag and infant changing station according to a further non-limiting embodiment of the present invention. The body in this embodiment can include any combination of rigid and/or flexible construction and can include a main body having each of front 52 and opposite side 54 and 56 zippered compartments, such as for holding supplies related to infant diaper changing or the like. Also depicted is a main support strap 58 (such as which can include a cushioned middle area 59) which extends from first 60 and second 62 clipped or other secured locations to the main body. A secondary strap 64 is also partially depicted and, as shown in FIG. 7, and is likewise secured to the main body at similar locations as the first strap 58 for providing additional support when worn by a user 2.

FIG. 7 is a further perspective illustration of the convertible changing station of FIG. 6 shown in an outwardly folded and opened position. As with the first embodiment 10, any suitable latching or retaining structure is envisioned for retaining the body 50 in the closed configuration of FIG. 6 until it is desired to convert to the opened configuration of FIG. 7. Similar to the first disclosed embodiment, the body 50 in the open position reveals a base portion 66 (generally corresponding with an upper half) which supports the straps 58 and 64 and which provides for supporting against such as the front of the wearer, again shown at 2.

A lower outwardly folding half of the body 50 includes a similar arrangement of central 68 and outer 70/72 interfolding panels. The panels 68, 70 and 72 can be hingedly secured along rear edges to each of the base portion 66 and reinforced triangular shaped reinforcement portions 74 and 76 are provided which are foldably connected to both the opposite side edges of the base portion 66 as well as with rear edges of the outwardly folding outer panels 70 and 72.

Figure 8:
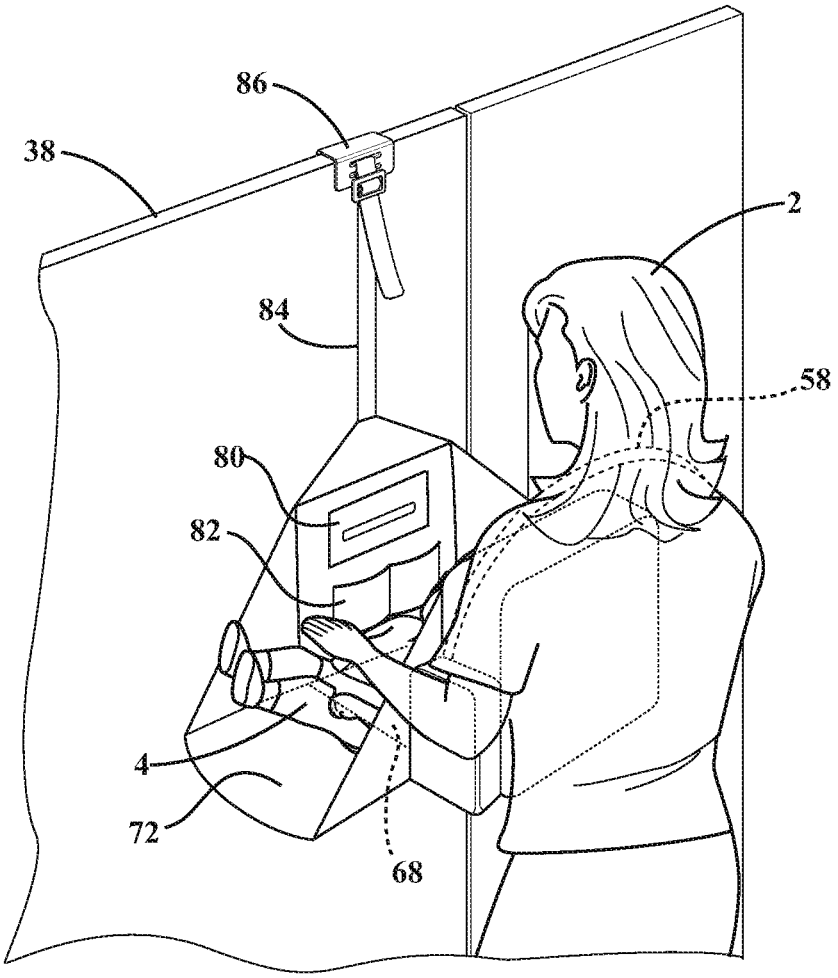
FIG. 8 depicts the convertible station of FIGS. 6-7 arranged in a related mounting configuration in which a strap supported hanger is additionally supported along a top door edge.

In similar fashion to the open converted configuration of FIGS. 3-5 of the first embodiment 10, the open panels 68, 70 and 72 collectively define a flat surface for supporting an infant 4 (see again in FIG. 8). A further and forward hinged panel portion is shown at 78 and is hingedly connected at least to a forward edge of the central support panel 68. The forward panel 78 defines a substantially triangular shape and includes a central area which supports forward facing receptacle or dispenser locations for such as wipes 80 and diapers 82 (and as opposed to the upper open and depth defining receptacles 28/30 of FIG. 3).

A further strap or lanyard 84 is depicted extending from a forward tapered edge of the forward panel 78 and, as further shown enlarged in FIG. 7A, can be attached or integrated with a wall hanger component 86 such that the strap 84 is length adjustable (see adjustment loop 88). The hanger component 86, similar to the clip 36 in FIGS. 2A-2B, can include any of a "C" or "U" shaped cross sectional profile adapted to secure to an upper edge of a door as depicted in FIG. 8, this shown at 38 and similar to the support arrangement of FIG. 3 and by which the upper door edge provides a first support location and the user supported straps 58/64 can provide a secondary support location.

In this manner, the user 2 (see again FIG. 8) can easily attend to changing the infant's 4 diaper or providing whatever other attention is required in a safe, elevated and sanitary environment.

Figure 7B:
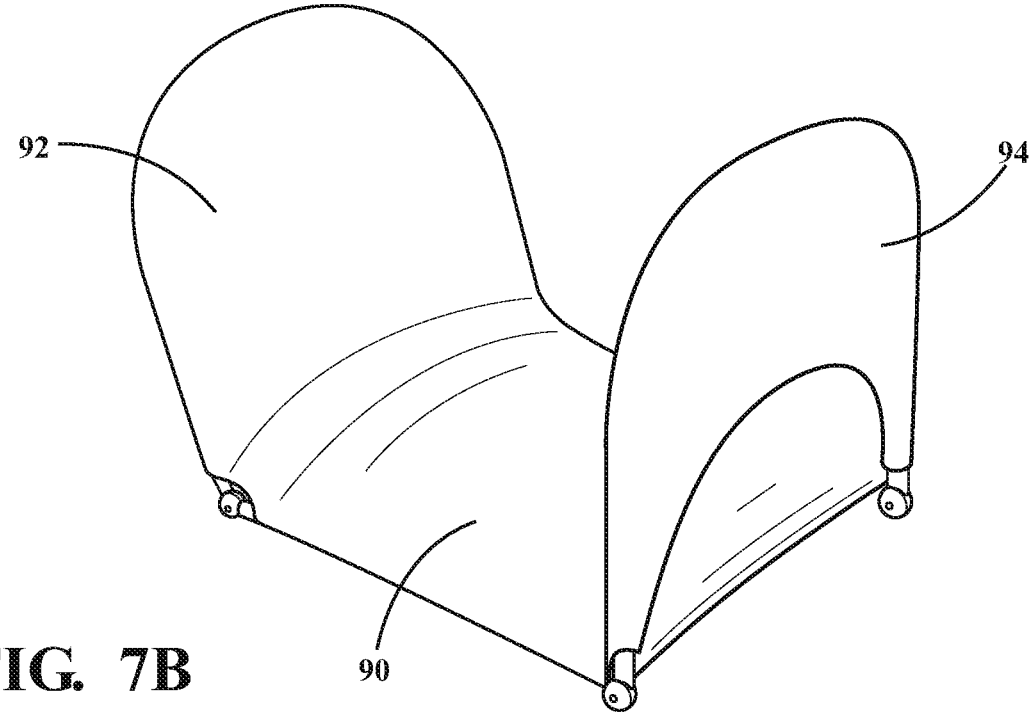
FIG. 7B is a further illustration of the removable pad in FIG. 7 and which can include a framework wrapped in a fabric material which is foldable between closed and open positions.

Referencing FIG. 7B, a removable pad is illustrated according to one non-limiting and foldable construction and which can include a multi-sided (such as three sided) construction with a central portion 90 and outer side portions 92 and 94. Without limitation, the pad support can include a conventional cushioning construction or can be constructed of flexible members not limited to rigid or flexible frame portions, and such as which can be wrapped in an outer fabric material such that the individual portions 90, 92 and 94 can by pivotally interconnected to one another between stored/closed and use/opened positions. In this fashion, the pad support can be utilized with the changing assembly or can be separately used depending upon the circumstances.

Accordingly, the present invention provides a number of varying configurations of the convertible backpack/changing assembly for either one or two person use in combination with a number of varying environments for accomplishing changing of the infant. Having described my invention, other and additional preferred embodiments will become apparent to those skilled in the art to which it pertains, and without deviating from the scope of the appended claims.

The detailed description and drawings are further understood to be supportive of the disclosure, the scope of which being defined by the claims. While some of the best modes and other embodiments for carrying out the claimed teachings have been described in detail, alternative designs and embodiments exist for practicing the disclosure as defined in the claims.

The invention claimed is:

1. A carry-able and convertible infant changing station, comprising:

a body having first and second hingedly connected halves which are convertible between a closed position and an opened position in which said first half folds downwardly from said second half;

side reinforcement flaps extending between pivotally displaced edges of said second half and said downwardly folded first half in order to structurally support said first half in a perpendicular orientation relative to said second half;

said downwardly folded first half further including a central panel and a pair of outer panels interconnected by reinforced hinges to define a support surface for the infant;

a pair of parallel disposed shoulder straps extending from said second body and adapted to being worn in a backpack style by a first individual;

a first neck strap extending from exposed edges of said first downwardly folded half and adapted to being worn about a neck of a second individual in a first elevated infant changing configuration in combination with the first individual; and a second hanging strap extending from upper edge locations of said second half, any of a clip or hanger secured to an intermediate location of said hanging strap and adapted to secure to an elevated location in order to suspend said body in said opened configuration in a second infant changing configuration.

2. The invention as described in claim 1 further comprising receptacles formed within said halves said exposed second half for supporting each of wipes and diapers for easy access to the individual.

3. The invention as described in claim 2, further comprising said receptacles exhibiting either forward facing dispensers or open receptacles.

4. The invention as described in claim 1, further comprising an easy open pull tab for converting said halves between the open and closed positions.

5. The invention as described in claim 1, further comprising at least one exteriorly accessible and zippered pocket configured within said body.

6. The invention as described in claim 1, further comprising a removable pad support contained within said body.

7. The invention as described in claim 6, said removable pad further comprising a three sided construction with a central portion and outer side portions.

8. The invention as described in claim 7, said pad support further comprising a plurality of frame portions defining said three sided construction and around which is wrapped an outer fabric material.

* * * * *